US010889403B2

(12) United States Patent
Domingues et al.

(10) Patent No.: US 10,889,403 B2
(45) Date of Patent: Jan. 12, 2021

(54) WOUND PACKAGE CONSTRUCT

(71) Applicant: General Mills, Inc., Minneapolis, MN (US)

(72) Inventors: David J Domingues, Plymouth, MN (US); Jason Nagy, Maple Grove, MN (US); James T Buccellato, Blaine, MN (US); Craig A Dowd, Egan, MN (US); Scott Kackman, New Hope, MN (US)

(73) Assignee: General Mills, Inc., Minneapolis, MN (US)

( * ) Notice: Subject to any disclaimer, the term of this patent is extended or adjusted under 35 U.S.C. 154(b) by 207 days.

(21) Appl. No.: 15/781,966

(22) PCT Filed: Dec. 12, 2016

(86) PCT No.: PCT/US2016/066182
§ 371 (c)(1),
(2) Date: Jun. 6, 2018

(87) PCT Pub. No.: WO2017/100777
PCT Pub. Date: Jun. 15, 2017

(65) Prior Publication Data

US 2018/0354673 A1 Dec. 13, 2018

Related U.S. Application Data

(60) Provisional application No. 62/265,683, filed on Dec. 10, 2015.

(51) Int. Cl.
*B65D 3/22* (2006.01)
*B65D 3/04* (2006.01)
(Continued)

(52) U.S. Cl.
CPC ..... *B65D 3/22* (2013.01); *B31C 3/04* (2013.01); *B65B 25/16* (2013.01); *B65D 3/04* (2013.01);
(Continued)

(58) Field of Classification Search
USPC ..... 53/456
See application file for complete search history.

(56) References Cited

U.S. PATENT DOCUMENTS 3,156,401 A 11/1964 Krause
3,195,427 A 7/1965 Adams
(Continued)

*Primary Examiner* — Michelle Lopez
*Assistant Examiner* — Chinyere J Rushing-Tucker
(74) *Attorney, Agent, or Firm* — Diederiks & Whitelaw, PLC; John L. Crimmins, Esq.

(57) ABSTRACT

A wound package construct includes a first wound strip of package material that establishes an inner liner layer, a second wound strip of material that establishes an intermediate bodystock layer, and a third wound strip of material or cover strip that covers a seam formed by the wound bodystock layer but that does not cover all of the outer surface area of the wound bodystock layer. Therefore, the width of the cover strip is less than the width of the bodystock strip. As a result, the cover strip is not wide enough to cover the entire outer surface of the wound bodystock layer such that, after the cover strip is wrapped to cover the spiral bodystock seam, areas of the bodystock layer remain exposed between the two opposed length-wise edges of the cover strip.

20 Claims, 4 Drawing Sheets

(51) Int. Cl.

| | |
|---|---|
| ***B31C 3/04*** | (2006.01) |
| ***B65D 85/36*** | (2006.01) |
| ***B65D 3/26*** | (2006.01) |
| ***B65B 25/16*** | (2006.01) |
| ***B65D 85/72*** | (2006.01) |

(52) U.S. Cl.
CPC ..... *B65D 3/261* (2013.01); *B65D 3/266* (2013.01); *B65D 85/36* (2013.01); *B65D 85/72* (2013.01)

(56) References Cited

U.S. PATENT DOCUMENTS 3,940,496 A * 2/1976 Turpin ..... B65D 3/267 426/123
3,981,433 A * 9/1976 Thornhill ..... B65D 3/22 229/202
3,982,686 A 9/1976 Parlour et al.
4,073,950 A * 2/1978 Hansen ..... B65D 3/22 426/128
4,343,427 A * 8/1982 Sansbury ..... B65D 3/22 206/524.8
4,717,374 A 1/1988 Elias
5,205,479 A * 4/1993 Rice ..... B65D 3/266 229/202
5,206,479 A 4/1993 Zakaria et al.
5,232,429 A 8/1993 Cizek et al.
5,318,499 A 6/1994 Rice et al.
5,494,215 A * 2/1996 Drummond ..... B65D 25/205 229/202
5,829,669 A * 11/1998 Drummond ..... B29C 53/78 229/4.5
5,934,547 A 8/1999 Vaughn et al.
6,604,307 B1 * 8/2003 Cahill ..... B65D 3/22 40/306
2011/0280998 A1 * 11/2011 Lorence ..... B65D 81/3233 426/118

* cited by examiner

WOUND PACKAGE CONSTRUCT

CROSS-REFERENCE TO RELATED APPLICATIONS

This application represents a National Stage application of PCT/US2016/066182 entitled "Wound Package Construct", filed Dec. 12, 2016, which claims the benefit of U.S. Provisional Application No. 62/265,683, which was filed on Dec. 10, 2015 and titled "Wound Package Construct". The entire content of these applications are incorporated herein by reference.

BACKGROUND OF THE INVENTION

The invention relates to wound package constructs, especially for use in a package to contain and store a food such as a refrigerator-stable, chemically-leavened dough composition, as well as methods for preparing and using the same.

Refrigerated, packaged dough products are popular consumer items because of their storage stability, convenience of use, and desirable baked properties (flavor, texture, coloration, aroma), which can be on par with freshly baked bread products. Many refrigerated dough products are sold commercially, packaged to be refrigerator-stable in a consumer-type package. The package is often pressurized to have an internal pressure that is greater than atmospheric, with many commercial products having internal pressures above two atmospheres absolute. Pressurized packaging configurations are used, for example, for dough products such as chemically-leavened biscuits, sweet rolls, donuts, pizza doughs, rolls, other forms of bread doughs.

The most common package for containing pressurized refrigerated dough products is the ubiquitous wound-cardboard self-sealing can. These packages, in various forms, have been a consumer staple for decades because of their ability to offer safe and stable transport, storage, and marketing for sale of refrigerated dough products. Their general construction includes a wound cardboard tube and two end caps, usually metal, that close the ends of the tube but also include a vent to allow air to escape when a dough located inside of the package expands.

More particularly, known wound containers for refrigerated dough products include layers of materials spirally wound in a manner to form sidewalls used to form can-type packages. The layers of conventional packages may include an inner or liner layer, a cardboard or paperboard bodystock layer, and an outer layer that often makes up a label. The different layers are held together by a first adhesive between the liner and the bodystock, and a second adhesive between the bodystock and the outer layer. Functions of the inner layer include: providing a barrier between the interior and exterior of the package; providing some of strength to hold the wound sidewall together; and, optionally providing structure at a wound seam that is capable of improving venting properties of the package. Functions of the bodystock are to provide the primary strength of the sidewall and of the can-type package, and to absorb oils and water that may be present at vented ends of the closed package. Functions of an outer label layer are to provide an amount of the required strength of the package to hold the wound sidewall together under pressure so that, when the outer layer is removed, the wound sidewall may be disrupted at the exposed seam to burst open. Such can-type packaging containers can be produced by forming a cylindrical winding of the inner liner layer, then placing a wound layer of the bodystock over the wound inner liner layer, and then placing a wound layer of the printed label layer about the wound bodystock, in that order.

In use, raw dough is placed at the interior of the wound can and the end caps are placed to close the ends. Leavening agent in the dough produces carbon dioxide, causing the dough to proof within the container. The proofing expands the dough to fill the interior space of the package. During proofing the dough pushes air out of vented ends of the can until the dough substantially fills the can. Dough that becomes pressed into the ends of the can will act as caulk, converting the vented ends into a gas-tight closure that is stable through commercial storage, distribution, and sale followed by use by a consumer.

To perform as part of a commercial refrigerated packaged dough product, a wound cardboard can-type packaging container preferably includes or allows for a combination of performance features that includes adequate venting at the ends after placement of the end caps, followed by sealing of the ends by the expanded dough, and sidewall that prevent the passage of oils, water, and gases including oxygen, carbon dioxide, and water vapor. Of course low cost is desired for commercial packages.

Additionally, preferred cans will include a convenient and easy opening mechanism that allows a consumer to easily open the package and remove the dough contents without substantial deformation of the dough. Pressurized cardboard cans are capable of various designs for opening to allow a user to remove dough contents. Many opening mechanisms involve removing an outer packaging layer such as the relatively lightweight paper labeling layer to expose a seam of an adjacent wound bodystock layer. After the seam is exposed, the seam can be disrupted and opened, or will open due to the elevated internal pressure of the package. The seam may be further opened by a user, e.g., unwound, to allow the dough contents within the opened package to be removed through a large opened seam.

Consistently high consumer demand exists for packaged refrigerated dough products. Generally, the dough industry has ongoing need for improvements in product and packaging configurations, including those that produce cost reductions.

SUMMARY OF THE INVENTION

The present invention relates to novel and inventive wound package constructs, methods of opening and/or preparing the constructs, and products such as packaged dough products employing the construct. In particular, the present invention provides for a package construct including adhesively bonded liner, bodystock and cover strips as defined in claim 1, methods of opening the package construct as defined by claims 13 and 14, and a method of preparing the package construct as defined by claim 15.

According to the present description, a wound package construct includes a first wound strip of package material that establishes an inner liner layer, a second wound strip of material that establishes an intermediate bodystock layer, and a third wound strip of material that covers a seam formed by the wound bodystock layer but that does not cover all of the outer surface area of the wound bodystock layer. That is, the cover strip is wound about the bodystock layer to cover a spiral seam that results from abutting opposed edges of the wound bodystock strip, while also covering a portion, but not all of, the adjacent bodystock material on both sides of the bodystock seam. Therefore, the width of the cover strip is less than the width of the bodystock strip. As a result, the cover strip is not wide enough to cover the entire outer surface of the wound bodystock layer such that, after the cover strip is wrapped to cover the spiral bodystock seam, areas of the bodystock layer remain exposed between the two opposed length-wise edges of the cover strip.

The cover strip is secured to the outer surface of the bodystock layer with cover adhesive that exhibits shear and peel properties sufficient to produce a high level of stability of the pressurized bodystock seam during commercial sale and transport, and that also allows a package made of the wound package construct to be opened either by peeling the cover strip away from the covered bodystock seam, or by applying pressure to cause a failure of the cover adhesive bond and to then disrupt the bodystock seam.

The wound package construct may include an additional layer if desired, such as for labeling, outside of the bodystock layer and cover layer. The additional layer can mostly or entirely have an aesthetic function, can take the form of a sleeve or wrap, and is not required to contribute to any substantial level of structural strength to the package.

The wound package construct of the invention can be adapted for use as a cylindrical sidewall of a pressurized package for containing a raw dough which is intended to be refrigerated. The dough can be placed at the package interior, the ends of the package can be covered and closed, preferably while accommodating at least some initial venting as the dough proofs and expands within the interior of the package. The expanded dough then seals the package from within and produces a pressurized package interior. The internal pressure may build within the interior of the package, even to a pressure that is greater than atmospheric pressure, such as a pressure in a range from about 5 to about 20 pounds per square inch (gauge), preferably from about 10 to about 15 psig. With this expansion, the dough contained in the package may achieve a raw specific volume in a range from 0.9 to 1.1 cubic centimeters per gram (as measured while the dough is in the package). The dough, when removed from the package, can be cooked to a baked or otherwise cooked dough product having expected properties of a baked dough product, such as baked a baked specific volume of at least 2.7 cubic centimeters per gram, e.g., at least 3.0 cubic centimeters per gram.

BRIEF DESCRIPTION OF THE DRAWINGS

The present invention will be described by way of example with reference to the accompanying drawings in which.

DETAILED DESCRIPTION

Figure 1:
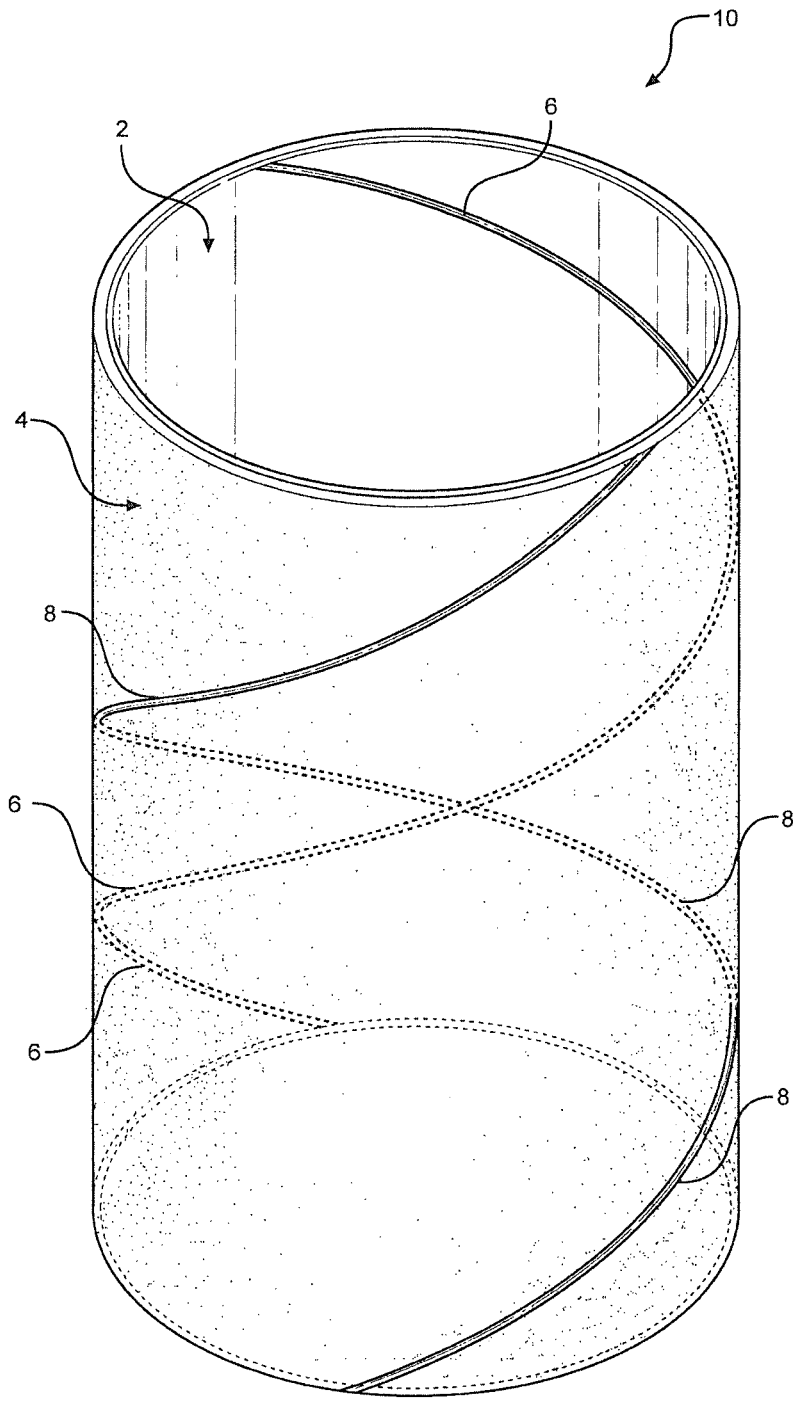
FIG. 1 is a perspective view showing an early stage in the formation of a package construct made in accordance with the invention.

Described are inventive wound package constructs, derivative products made from the wound constructs, and related methods of preparation and use. The wound package construct includes, consists of, or consists essentially of a cut or uncut wound sidewall that is constructed to include at least three layers of strip materials wound sequentially to form a hollow container, e.g., a hollow cylindrical tube, with adhesive between adjacent layers. The term wound package "construct" refers to an article that requires only the wound sidewall to be made of the respective three layers, with two adhesives, though other layers or items of a package are not excluded. The described construct is typically in the form of an elongate hollow tube defined by the sidewalls. The construct can vary in diameter (in cross section) and can be of essentially any length. More specifically, the length may be relatively short (e.g., a number of inches) useful to form a consumer product package, or quite long (e.g., a number of feet, e.g., 3 to 5 feet) if the construct is in the form of an uncut raw material packaging component, in which case the length may be many multiples of a length of a consumer product package (can) that will be prepared by cutting the longer construct into separate shorter lengths. With the construct in the form of a sidewall for a consumer product package (wound can), the length is generally in a range from a few to several inches, e.g., from 3 to 12 inches. The diameter (in cross-section) may be as desired for forming a food product package as described herein, e.g., from about 1 inch to about 6 inches, preferably from about 1.5 inches to about 3 or 4 inches.

As detailed more fully below, strip materials useful to prepare the construct include a first strip of material that functions as an inner or liner layer, a second strip of material that functions as an intermediate bodystock layer, and a third, more narrow cover strip that is wound to cover a spiral seam formed by the bodystock layer being wound. The construct may include an additional, fourth layer such as a printed label layer, if desired, which may be located over the outside surfaces of the cover strip and bodystock layer.

The inner liner layer and the bodystock layer are strips of packaging materials each preferably having a uniform width. The two layers may each exhibit substantially the same width, or the width of the liner layer may be slightly greater than the width of the bodystock layer, to optionally allow for one edge of the liner layer to be folded, to allow for one edge of the liner layer to overlap the other edge when wound, or to allow for both. The liner layer and bodystock layer are wound into a spiral cylinder and are held together by adhesive. The inner liner layer will include a spiral liner seam formed where one edge of the liner strip meets the other edge along a spiral path at the interior of the sidewall, optionally with overlapping of the edges. The bodystock layer will include a spiral bodystock seam formed where one edge of the bodystock strip meets and abuts the second edge.

The cover strip is placed and secured on the outside surface of the wound bodystock layer at a location to cover the spiral bodystock seam. Important in connection with the invention is that the cover strip has a width that is narrower than the width of the strip of the bodystock layer, making the cover strip not sufficiently wide to cover the entire outer surface of the wound bodystock layer. As a result, areas of the bodystock layer remain uncovered by the cover strip, between the two opposed edges of the cover strip covering the spiral bodystock seam. The cover strip is preferably secured to the outside bodystock surface using a cover adhesive.

Referring to FIG. 1, a wound package construct 10 is shown to include a wound inner or liner layer 2 and a wound bodystock layer 4 covering the wound inner liner layer 2. Spiral liner seam 6 is located at an inside surface of package construct 10. At this point, it should be noted that spiral liner seam 6 is shown to be generic, i.e., to not specifically include or require one or more of a folded edge or overlapping between the edges. However, as described herein, spiral liner seam 6 can include one or more of a folded edge, overlapping of one edge on top of another edge, adhesive such as a hot-melt adhesive applied to the liner layer, or combinations of these, such as to produce a seam known in the packaging arts as an "anaconda fold." According to certain embodiments, spiral liner seam 6 can be formed by folding one edge of the liner layer and then winding the liner layer in a manner to cause the folded edge to be placed onto and overlap the non-folded edge, where the edges meet. Such embodiments will be discussed further hereinafter with reference to FIGS. 3A and 3B.

The liner layer 2 is included at the inside surface of the wound sidewall to provide one or multiple functions. In particular, the liner layer protects the adjacent bodystock layer by preventing the bodystock layer from being exposed directly to moisture of a dough product contained at the interior of the sidewall. In addition, a preferred liner layer will provide barrier properties against the passage of gases and liquids such as by preventing oxygen from entering the closed package, and by preventing carbon dioxide, water vapor, and water from exiting the package. Barrier properties may be provided by liner materials coated with a metal (e.g., aluminum) or a polymeric barrier layer. By way of example, the liner layer can provide a package that exhibits: a maximum carbon dioxide transmission of 1.6, e.g., 0.7 cubic centimeters per 100 $(\text{inches})^2$/24 hrs/atm at 72° F.; a maximum oxygen transmission of: about 1, e.g., from about 0.2 to about 0.6 cubic centimeters per 100 $(\text{inches})^2$/24 hrs/atm at 72° F.; and nominal WVTR (water vapor transmission rate) of from about 0.1 to 0.15.

Materials useful for an inner liner layer 2 are well known. Example materials include paper materials that may optionally include a metallic or foil layer or a polymer layer. The metallic, foil, or polymer layer can be useful provide a barrier to gases or liquids. Optionally a polymer layer can also provide lubrication or reduced friction for winding the layer during preparation of the wound sidewall. General examples of liner layer materials include a Kraft paper substrate (e.g., 10 to 40 pound wet strength) coated with a metallic or foil layer and a polymer.

The second layer of material of the wound sidewall is the bodystock layer 4, located at the outside surface of the wound liner layer and secured to the outside liner surface by adhesive, i.e., the liner adhesive. The bodystock layer 4 is the primary strength-providing component of the wound construct. The bodystock provides the primary structural integrity of the construct, the sidewall, and of a can-type package prepared from the wound construct. The bodystock is responsible for preventing the contents of the package from experiencing physical damage during manufacturing, packing, and distribution of a packaged dough product. The bodystock can also absorb water or oil that may contact the ends of the sidewalls in a finished package, such as by passing into the vent space present between a sidewall end and an endcap attached at the sidewall end.

Materials useful for a bodystock layer or strip 4 include known and commercially available paper and cardboard packaging materials. These include cardboard or paperboard materials having size (e.g., thickness), weight, and rigidity properties that will be effective to provide strength and rigidity properties in a wound sidewall and in a finished package. General examples of bodystock materials can include paperboard and paperboard substrates of a weight and rigidity known to be useful in wound cardboard packages used to contain refrigerated doughs, e.g., 5 to 50 pound wet strength. The type of paper or cardboard can also vary as desired, with various types being known and suitable for a refrigerated dough package, one example being natural Kraft paper. The surface texture of the bodystock can preferably be a natural, uncoated paperboard or cardboard to facilitate the use of adhesive to secure an inner liner layer on the inside and a cover strip on the external side of the wound bodystock.

Still referring to FIG. 1, a spiral bodystock seam 8 is created along where one of the edges of bodystock layer 4 meets an opposed edge. This type of spiral bodystock seam is often referred to as a "butt joint" in the packaging arts. The butt joint is produced by winding the bodystock strip in a manner to cause one edge of the strip to closely abut the opposed edge during winding so that the two opposed edges meet to form essentially no gap, without overlapping. Therefore, bodystock seam 8 is a butt joint that includes one edge of wound bodystock layer 4 closely meeting the opposed edge without any overlapping of one edge over the other edge. Spiral inner liner seam 6 can be offset from spiral bodystock seam 8, or may coincide with spiral bodystock seam 8, as will be discussed more fully below. By offsetting the two spiral seams, the strength of the sidewall can be increased or controlled as desired, and the force required to open the package along the spiral bodystock seam 8 can be affected or controlled as desired. In any case, the wound bodystock layer 4 includes two opposed bodystock edges which, when the bodystock strip is wound into the spiral sidewall, will meet at a spiral bodystock seam 8.

To provide a desired level of bonding between the wound liner layer 2 and the wound bodystock layer 4, a liner adhesive (not separately shown) is placed between the outside surface of the wound liner layer 2 and the inside surface of the wound bodystock layer 4. The liner adhesive can be one that is useful in a food product, many examples of which are known and commercially available. Exemplary adhesives include a polyvinyl acetate adhesive, a polyvinyl alcohol adhesive and a blend thereof. The adhesive can be applied to the bodystock strip before the bodystock strip is wound onto the wound liner layer. In this manner, the adhesive will produce an strong, quick, aggressive bond between to wound liner layer and the bodystock strip, as the bodystock strip is being wound, to stabilize the construct during the winding process.

Figure 2:
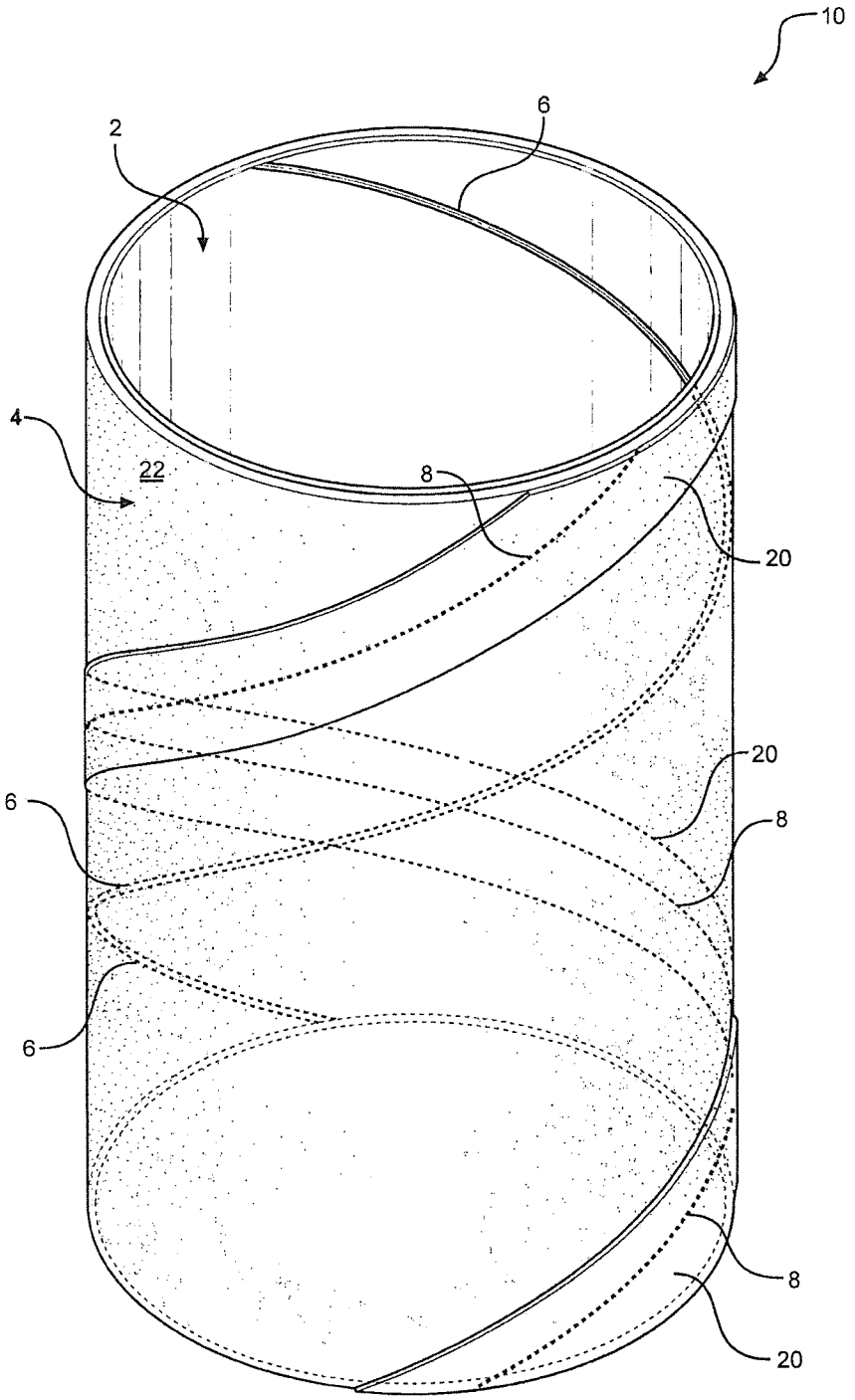
FIG. 2 is a perspective view showing a later stage in the formation of the package of FIG. 1.

Important in connection with the present invention is the inclusion of a third material of the wound construct as defined by a cover strip 20 that is placed at the outside surface of the wound bodystock layer 4 and secured with cover adhesive to the outside bodystock surface. Referring to FIG. 2, construct 10 includes the sidewalls described with reference to FIG. 1, and additionally includes cover strip 20 placed over spiral seam 8. As illustrated, the width of cover strip 20 is sufficient to cover spiral seam 8, but leaves open areas 22 of wound bodystock layer 4 exposed between the two opposed edges of cover strip 20. According certain preferred construct embodiments, the cover strip is a strip of material having substantially uniform width and a length that extends along a length of the outside bodystock surface to cover the spiral bodystock seam. More particularly, the cover strip 20 includes two opposed cover strip edges (not separately labeled) defining the lengthwise sides of the cover strip 20. The width of the cover strip 20 is less than the width of the bodystock strip 4, meaning that, when the cover strip 20 is wound about the spiral bodystock seam 8, the edges of the cover strip 20 do not meet on the outer surface of the construct 10. The width of the cover strip 20 is sufficient to cover the spiral bodystock seam 8 along with some portion of the outside bodystock surface located adjacent to and on each side of the spiral bodystock seam 8. But the width of the cover strip 20 is not sufficient to cover the entire surface of the wound bodystock layer 4, and, as a result, open areas of the outer bodystock surface remain uncovered between the edges of the wound cover strip 20 as clearly shown in FIG. 2. The width of a cover strip 20 for a particular product construct can be selected as needed. For instance, the width of the cover strip can be within 1-3 inches, with a preferred width being 1.5 inches. This preferred width is advantageous for use with a bodystock layer having a width of about 4 inches, with reasonable bodystock layer widths being 2-6 inches.

Figure 3A:
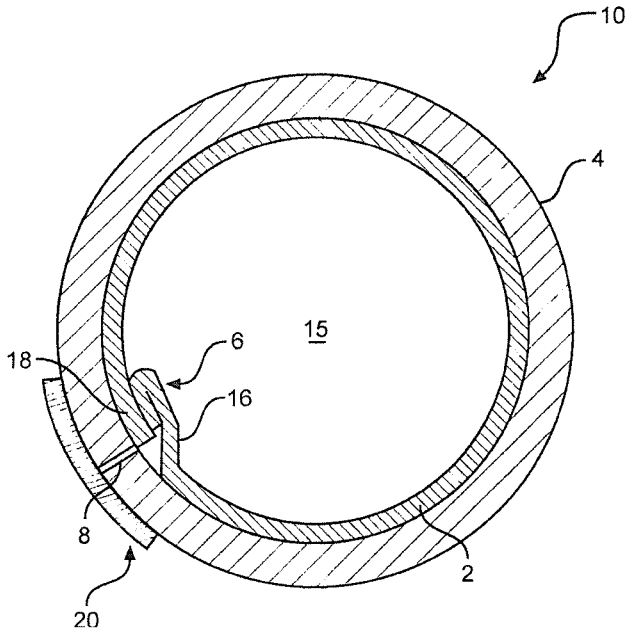
FIG. 3*a* is a top view of one embodiment of the package construct.
Figure 3B:
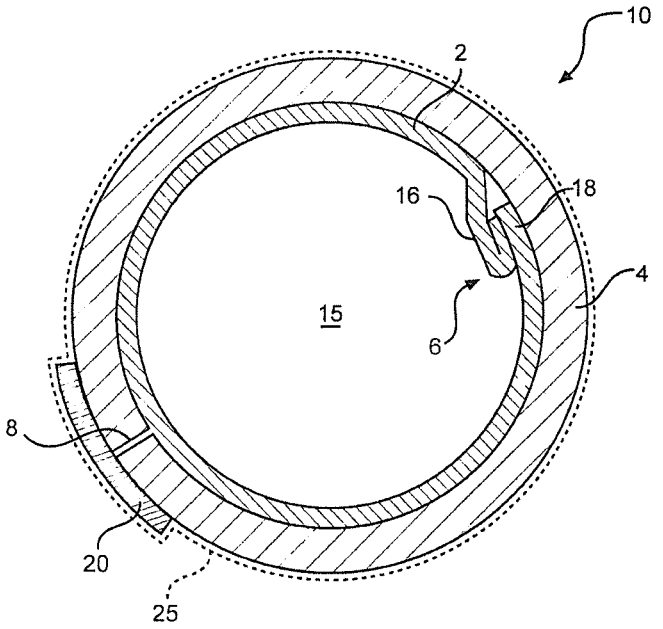
FIG. 3*b* is a top view of another embodiment of the package construct.

In certain constructs such as shown in FIGS. 3A and 3B, the wound liner layer 2 can include one edge that is folded and then heat sealed to the second wound edge, while overlapping the second wound edge. As referenced above, this type of a seam is sometimes referred to in the package arts as an "anaconda fold." To prepare the fold, one edge of the liner layer can be folded prior to winding. When wound, the same edge is then wound to overlap the opposite edge of the liner layer strip and a heat seal can be applied to bond the folded edge to the exposed surface of the un-folded edge. The anaconda fold is thereby constructed at a spiral seam produced when the liner is wound. The fold at the two edges of the wound liner seam form a small surface structure which acts as a minute channel that is sufficiently large to allow air to pass from an inner portion of the sidewall, along the sidewall at the wound liner seam, to an end of the sidewall. This improves the ability of air to be vented from the middle portions of the sidewalls when raw dough is expanded within the interior space of a package that includes the sidewalls.

FIGS. 3A and 3B show side views (cross-sections) of embodiments of the described constructs. In side view, an inner surface of liner layer 2 is exposed to an interior space 15 of construct 10. Bodystock layer 4 is located at an outer surface of inner liner layer 2. Spiral liner seam 6, located at the interior of construct 10, includes folded edge 16, with folded edge 16 being wound to overlap non-folded edge 18. Spiral bodystock seam 8, includes two edges of bodystock layer 4 in close abutted orientation, e.g., abutting contact, without one edge overlapping the other. Cover strip 20 covers spiral bodystock seam 8 and portions of an outer surface of bodystock layer 4 on each side of bodystock seam 8.

In FIG. 3A, bodystock seam 8 and spiral liner seam 6 coincide, i.e., are at the same location of the circumference of the sidewall of construct 10. In alternate embodiments, such as shown at FIG. 3B, bodystock seam 8 and spiral liner seam 6 may be offset, e.g., by 180 degrees along the circumference of the sidewall of construct 10, or by more or less than 180 degrees, e.g., by 90 degrees or less than 90 degrees, such as from about 5 to about 50 degrees. Desirably, by having bodystock seam 8 and spiral liner seam 6 coincide or be offset by a relatively small amount, such as from about 5 to about 20 degrees, cover strip 20 may be sufficiently wide to cover bodystock seam 8 as well as a location on the exterior of bodystock layer 4 that coincides with spiral liner seam 6. Cover strip 20 would then cover both the butt joint of bodystock seam 8 and the exterior location of the liner seam 6 at the interior side of the bodystock layer 4, and would act as a barrier to prevent passage of fluid or gas through liner seam 6 and then through bodystock seam 8, or through liner seam 6 and bodystock layer 4. In embodiments with greater offset between bodystock seam 8 and liner seam 6, a separate strip of barrier material could be placed over the exterior of bodystock layer 4 at the location of liner seam 6, if necessary to prevent leakage of fluid or gas that may pass through liner seam 6 and then bodystock layer 4.

Shown only in phantom in FIG. 3B and not shown at FIG. 1, 2 or 3A is an optional fourth layer 25 of a packaged product, which can be a packaging or labeling layer for improving the aesthetics of a commercial package made using construct 10, or for providing printed product information. The fourth layer 25 can be non-structural, meaning that the fourth layer is not required to provide strength or structural integrity to the package made with construct 10. In a preferred embodiment, the labeling layer 25 is constituted by a sleeve, while in other embodiments another wound layer could be employed. If provided, the fourth layer 25 can be removed to expose the wound bodystock layer 4 with spiral bodystock seams 8 covered by the cover strip 20 as best shown in FIG. 2.

According to the described constructs, the cover strip adhered to the spiral bodystock seam will function to hold the spiral bodystock seam together, typically under pressure, during the life of a packaged refrigerated dough product contained in a package made using the construct. The cover strip and cover adhesive (see below) contribute to the strength of the construct by bridging the butt joint bodystock seam and holding the butt joint seam together in opposition to the internal pressure of the packaged product.

According preferred embodiments of the described package constructs, when used to construct a package for a pressurized refrigerated dough product, the cover strip also functions as a component of an opening feature. When dough is placed in a described package construct, and end caps are placed to close sidewall ends to produce a container for a packaged dough product, the dough inside of the package or container places pressure on the sidewalls when the dough expands and pressurizes the package interior. Due to the nature of this "plastic pressure," certain preferred mechanisms for opening a refrigerated raw packaged dough product desirably produce a relatively large opening in the package, very quickly, to prevent deformation of the dough during the opening process. A slow release of pressure from the dough can result in deformation of the dough, which is undesirable. Accordingly, a preferred sidewall or construct as described herein is capable of being used in a pressurized raw dough product package, to produce a package that is capable of being opened to produce a relatively large opening along the spiral bodystock seam in a very short amount of time. Preferred opening mechanisms are of a type that cause a burst along the spiral bodystock seam that quickly opens a length of the bodystock seam without permanently deforming the dough contents. The size of an initial opening along a length of the seam can be increased by a user further unwinding the bodystock layer. As an example, certain preferred opening mechanisms can produce an initial opening along the bodystock seam of at least 1 or 2 inches in length, e.g., at least 4, 5, 6 or more inches in length, with the opening being formed in a relatively short time period such as less than 2 seconds, e.g., less than 1 or 0.5 second. The package may be manipulated to form a larger opening in the seam, if desired or necessary, by a user further unwinding the wound bodystock layer.

According to certain such opening mechanisms in a pressurized dough package prepared from a construct as described, an opening in the package can be produced by unwinding the cover strip to peel the cover strip away from the wound bodystock layer, to uncover the spiral bodystock seam, which is under pressure. The cover adhesive preferably has adhesion properties that allow the cover strip to be removed by failure of the cover adhesive by peeling the cover strip away from the underlying bodystock layer. When the cover strip is peeled away, the package is weakened along the spiral bodystock seam. The weakened spiral bodystock seam may burst open due only to the internal pressure at the package interior, or may be caused to burst open due to the internal pressure at the package interior in conjunction with manual assistance such as the use of a consumer's finger, thumb, a spoon, or another object used to place pressure at the uncovered bodystock seam.

According to alternate opening mechanisms, still useful to quickly produce a relatively large seam opening, the cover strip does not need to be removed. Instead, the package can be cause to open at the spiral bodystock seam by use of pressure to disrupt the cover adhesive that adheres the cover strip to the wound bodystock layer, and then to disrupt the spiral bodystock seam. The cover strip and the cover adhesive, while intact, are able to provide a stable closure for the canned dough product along the spiral bodystock seam. Advantageously, because of the relatively narrow width of the cover strip and its flexibility and ability to bend, the adhesive bond that adheres the cover strip to the underlying bodystock layer can be disrupted relatively easily using external pressure applied to the cover strip. The pressure may be from a finger or thumb, or a spoon, etc., sufficient to bend the cover strip and adjacent bodystock layer by an amount that will cause failure of the cover adhesive between the cover strip and the bodystock layer. The use of pressure to cause failure of the cover adhesive bond removes the bridging support that is provided by the adhered cover strip and intact cover adhesive. After such initial pressure successfully causes failure of the cover adhesive bond, an additional amount of pressure (in combination with internal pressure within the package) will destabilize and open the spiral bodystock seam, causing a length of the seam to burst open, optionally also tearing the package at the liner layer.

According to constructs as described, a width of the cover strip can be selected in combination with the cover adhesive to achieve desired opening properties of a pressurized raw dough product package. Other factors will also affect opening properties, such as the strength of the liner layer and the internal package pressure, but the width of the cover strip and the shear and peel strength of the cover adhesive can have a large impact on opening properties. For example, in certain embodiments a width of the cover strip can be sufficiently narrow to allow the cover strip to become debonded from the bodystock layer by pressure applied through the cover strip at the bodystock seam. If the width of the cover strip is too great this may be difficult due to the increased adhesive bond strength between a wider cover strip and the bodystock layer.

A material useful as the cover strip can be any package material capable of being secured to the outside surface of the wound bodystock layer, using the cover adhesive, in a manner to cover the spiral bodystock seam and portions of adjacent bodystock surfaces, to hold the pressurized spiral bodystock seam together and produce a stable refrigerated raw dough product. Preferred materials also allow for a preferred opening mechanism as described herein. Various examples of polymeric or paper packaging materials can be useful. Exemplary cover strip materials can be paper or polymer optionally coated with a metallic (e.g., foil) or polymeric barrier layer, with the cover strip layer providing a wet strength from about 10-80 pounds. The cover strip may provide barrier properties to gases (oxygen, moisture vapor, carbon dioxide) or liquids (oils, water), but is not required to provide such barrier properties.

To provide a desired level of bonding between the wound bodystock layer and the wound cover strip, a cover adhesive is placed between the outside surface of the wound bodystock layer and the inside surface of the wound cover strip. The cover adhesive may be one that is useful in a food product package (e.g., generally regarded as safe, i.e., "GRAS"), many examples of which are known and commercially available. One example of a useful type of cover adhesive is the class of GRAS starch adhesives, including dextrin adhesives. The dextrin adhesive can be applied to the cover strip before being wound about the wound bodystock layer. The cover adhesive can provide desired shear and peel properties to provide a bond of the cover strip over the spiral bodystock seam that is sufficient to hold the seam together, under pressure. Preferably, a cover adhesive bond can also be caused to fail by peeling the cover strip away from the wound bodystock layer or, alternatively, by placing pressure on the cover strip at the spiral bodystock seam in a manner that flexes and bends the sidewall and cover layer at the seam to place sufficient shear or peel forces on the cover adhesive to disrupt and cause failure of the cover adhesive bond.

A wound package construct as described can be prepared by winding each of the liner layer strip, the bodystock layer strip, and the cover strip, in that order, into a cylindrical form, such as by forming a wound cylinder over a mandrel. Methods and equipment useful for winding cardboard cylinders such as those used in raw dough product packages are known and are described in U.S. patent documents U.S. Pat. Nos. 3,156,401, 3,982,686, 4,343,427, 4,717,374, 5,206,479, 5,318,499, 5,934,547, with these documents being incorporated herein by reference in their entireties.

Figure 4:
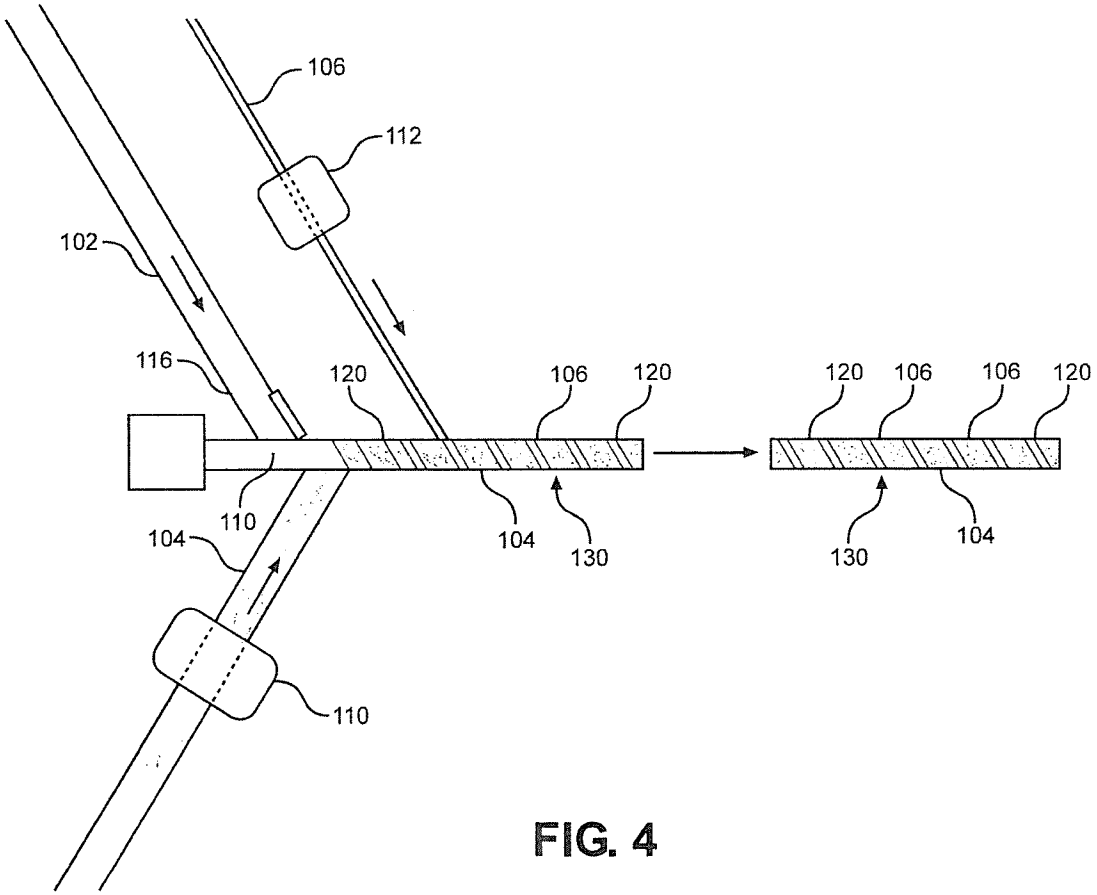
FIG. 4 schematically illustrates the assembly of the package construct.

As illustrated at FIG. 4, packaging materials 102 (liner layer), 104 (bodystock layer), and 106 (cover strip) are wound onto mandrel 110 to form cylindrical construct 130. The first wound packaging material is liner layer strip 102. The angle of the winding (i.e., the angle at which liner strip 102 is introduced to mandrel 110), the width of liner layer 102, and the amount of overlap of the opposed edges of the liner layer 102 when wound, determine the diameter of wound construct 130. As illustrated, a folder or adhesive applicator 116 can be located at one edge of liner layer 102 as liner layer 102 engages mandrel 110. Optionally, folder or adhesive applicator 116 can fold an edge of layer 102 and apply adhesive to the edge layer (e.g., at an edge, with or without folding). Also optionally and preferably one of the edges of layer 102 can be wound to overlap the other edge, when wound.

After layer 102 is wound onto mandrel 110, bodystock layer strip 104 is wound over wound liner layer 102. The angle at which bodystock strip 104 is introduced to mandrel 110, along with the width of bodystock strip 104 and degree of overlap of the opposed edges of bodystock strip 104, again determine the diameter of wound construct 130. The angle for introducing bodystock layer strip 104 should produce a diameter of the bodystock layer that is sufficient to place the bodystock layer 104 smoothly onto the wound liner layer 102, meaning that the diameters of the layers are substantially the same, as are the angles for introducing each layer to the mandrel. Preferably, bodystock strip 104 can be wound in a manner so that the opposed edges of strip 104 do not overlap upon winding, but closely abut each other to form a tight spiral bodystock seam 120 that does not include any overlapping of the two opposed edges, but that does produce tight contact between the two opposed edges.

Optionally and preferably adhesive applicator 110 can apply liner adhesive to the inside surface of bodystock layer strip 104 just before winding.

After bodystock layer 104 is wound about wound liner layer 102, cover strip 106 is wound over the wound bodystock layer to cover spiral bodystock seam 120 and a portion of the wound bodystock layer 102 that is adjacent to and on either side of spiral bodystock seam 120. The angle for introducing cover strip 106 to mandrel 110 should be substantially the same as the angle used to introduce bodystock layer 104 to the mandrel, so that the wound cover layer continuously covers spiral bodystock seam 8. Optionally and preferably, adhesive applicator 112 can apply cover adhesive to the inside surface of cover strip 106 just before winding. As shown at FIG. 4, cover strip 106 has a width that is less than the width of liner layer 102. When cover strip 106 is wound at a location to cover spiral bodystock seam 120 (shown as a dashed line when covered by cover strip 106), uncovered areas of bodystock 104 remain visible between the edges of wound cover strip 106 along a spiral length of construct 130.

The described construct can be cut to size and used for containing a raw refrigerated dough, under pressure, for commercial transport, storage, and sale. According to various examples of packaged dough products made using the described construct, a raw dough can be placed in a package prepared from a wound construct as described. End cap closures may be placed at ends of the sidewalls to provide closed and vented package ends that may be sealed by expansion of dough within the closed package. The dough will expand within the package to fill the inside of the package, with air at the package interior being forced out of the package through vents at the package ends. After the dough expands to remove the air and then to seal the package at the ends, the dough will continue to build pressure within the interior of the package to a pressure that is greater than atmospheric pressure, such as a pressure in a range from about 5 to about 20 pounds per square inch (gauge), preferably from about 10 to about 15 psig. With this expansion the dough contained in the package may achieve a raw specific volume in a range from 0.9 to 1.1 cubic centimeters per gram (as measured while the dough is in the package). The dough, when removed from the package, can be cooked (e.g., baked) to a baked or otherwise cooked dough product having expected properties of a baked dough product, such as baked a baked specific volume of at least 2.7 cubic centimeters per gram, e.g., at least 3.0 cubic centimeters per gram.

The packaged dough product can be sufficiently stable at the achieved internal pressure to be capable of being transported, stored, and handled without the wound sidewalls of the package becoming unsealed, i.e., without failure of the spiral bodystock seam. Preferred refrigerated packaged dough products can be stable, not experiencing failure of the spiral bodystock seam, for a refrigerated shelf life in a range from 75 to 90 days (e.g., at about 45 degrees Fahrenheit).

As indicated above, the package construct of the invention is particularly adapted to store raw dough compositions which can at least partially proof within the package, are adapted to be refrigerated, and are designed to be removed from the package prior to cooking. Such dough compositions are known in the art and do not form part of the present invention. However, for the sake of completeness, certain details of the dough composition will be mentioned. The dough compositions may be chemically leavened, and may include useful ingredients such as flour, water, optional fat, optional sweetener, optional yeast (e.g., for flavoring), and chemical leavening agent such as an acidic chemical leavening agent and a basic chemical leavening agent. Acidic chemical leavening agents are known in the dough and bread-making arts, with examples including sodium aluminum phosphate (SALP), sodium acid pyrophosphate (SAPP), monosodium phosphate, monocalcium phosphate monohydrate (MCP), anhydrous monocalcium phosphate (AMCP), dicalcium phosphate dihydrate (DCPD), glucono-delta-lactone (GDL), as well as a variety of others. Acidic chemical leavening agents come in a variety of solubilities at different temperature ranges, and may be either encapsulated or non-encapsulated. Commercially available acidic chemical leavening agents include those sold under the trade names: Levn-Lite® (SALP), Pan-O-Lite® (SALP+MCP), STABIL-9® (SALP+AMCP), PY-RAN® (AMCP), and HT® MCP (MCP).

Acidic chemical leavening agents that are considered to be of relatively high solubility include agents that are soluble in a liquid (e.g., aqueous) component of a dough composition at a temperature used during processing (e.g., from 40 to about 72 degrees Fahrenheit) or at a refrigerated storage temperature (e.g. from about 32 to about 55 degrees Fahrenheit). Examples of acidic chemical leavening agents that can be active at a processing temperature include monosodium phosphate, monocalcium phosphate monohydrate (MCP), anhydrous monocalcium phosphate (AMCP), dicalcium phosphate dihydrate (DCPD), glucono-delta-lactone (GDL), SAPP 60, SAPP 80, etc., normally but not necessarily in a non-encapsulated form.

Other acidic chemical leavening agents are only slightly soluble (e.g., are insoluble) at processing and refrigerated temperatures, e.g., are only slightly soluble in an aqueous component of a dough composition at processing and refrigerated storage temperatures. Such insoluble acidic chemical leavening agents can be included in a dough composition to remain relatively insoluble and therefore relatively inactive during processing, packaging, and storage of a dough composition, and then to become dissolved in a dough composition at a temperature experienced during cooking so as to react that with a basic agent to produce carbon dioxide during cooking. Examples of useful insoluble acidic chemical leavening agents include SALP and relatively slower reacting SAPP (e.g., low activity SAPP, for example SAPP-RD-1, 26, 28), as well as other acidic agents that exhibit solubility behavior similar to SALP and low activity SAPP.

Certain embodiments of dough compositions can include one or multiple types of acidic chemical leavening agent, for selected activity at different temperatures that occur during processing and cooking of the dough composition. For example, a single relatively soluble acidic agent such as soluble SAPP may be present in a dough composition. Alternately a combination of two or more soluble acidic agents can be included in a dough composition. According to yet other embodiments, a dough composition may include a combination of two or more acidic chemical leavening agents having different activity levels, e.g., one acidic agent that is of high solubility (at processing temperatures) that dissolves to a sufficient degree during processing to react with a basic agent to produce carbon dioxide, and another that is sufficiently insoluble to not dissolve or react at processing, packaging, or refrigerated storage temperatures.

The amount of total acidic chemical leavening agent included in a dough composition can be an amount sufficient to neutralize a total amount of basic chemical leavening agent in the dough composition, e.g., an amount that is stoichiometric to the total amount of basic chemical leavening agent, with exact amounts being dependent on the particular basic and acidic chemical leavening agents. A typical amount of total acidic chemical leavening agent such as SALP, SAPP, GDL, or combinations of SALP SAPP, GDL, or another, may be in the range from about 0.25 to about 3 weight percent based on the total weight of a dough composition, e.g., from about 0.25 to about 1.5 weight percent based on the total weight of the dough composition.

For dough compositions that include two types of acidic agents, such as a soluble acidic leavening agent in combination with an insoluble acidic leavening agent, these can each be present to produce desired carbon dioxide evolution during processing (e.g., packaging) and during cooking. An amount of soluble acidic chemical leavening agent can be an amount in the range from 0.25 to 2 weight percent relatively soluble acidic chemical leavening agent, based on the total weight of a dough composition. An amount of insoluble acidic chemical leavening agent (i.e., insoluble in a dough composition at 40 to 72 Fahrenheit) can be an amount in the range from 0.1 to 2 weight percent relatively insoluble acidic chemical leavening agent, based on the total weight of a dough composition.

Useful basic chemical leavening agents are generally known in the dough and baking arts and include soda, i.e., sodium bicarbonate ($NaHCO_3$), potassium bicarbonate ($KHCO_3$), ammonium bicarbonate ($NH_4HCO_3$), etc. The basic agent may be encapsulated or non-encapsulated. Both encapsulated and non-encapsulated basic chemical leavening agents are generally known and commercially available, and can be prepared by methods known in the baking and encapsulation arts. Optionally, a dough compositions can contain either a single or multiple different types of basic agent, either a single type of basic agent or single degree of encapsulation, or a combination of basic agents having different degrees of encapsulation e.g., from non-encapsulated "free" soda, to encapsulated soda of varying degrees of encapsulation and activity.

In addition to specific chemistries, encapsulated basic chemical leavening agents can be characterized based on their "activity," which refers to the percentage by weight of active basic agent that is contained in encapsulated particles, based on the total weight of active basic agent and encapsulating material that make up the particles. According to the invention, useful activities of an encapsulated basic chemical leavening agent can be any activity that provides a desired amount of exposure of the basic agent to a dough composition either during processing or during baking. Examples of useful activities can be, e.g., at least 30 percent, 50 percent, 60 percent, 70 or 75 percent.

The total amount of basic chemical leavening agent that may be included in a dough composition can be any useful or desired amount, e.g., an amount sufficient to react with a total amount of acidic chemical leavening agent to release a desired amount of carbon dioxide gas for leavening at the various stages of packaging, refrigerated storage, and cooking.

Exemplary amounts of basic chemical leavening agent (not including the weight of any encapsulating material) may be any amount that will produce a pressurized packaged product as described, with useful amounts being in the range from about 0.5 to about 1 weight percent based on total weight of a dough composition, e.g., from about 0.6 to about 0.9 weight percent based on the total weight of the dough composition.

The chemically leavened dough composition can be any of various different types of dough compositions that are often sold commercially. Sometimes different dough compositions can be classified into developed or non-developed doughs. The degree of development of a dough (as in a "developed" versus a "non-developed" dough) generally refers to the strength of a dough's matrix, as the strength relates to the degree of development of gluten (protein) in a dough matrix. During processing of a dough composition, gluten can be caused or allowed to interact or react and "develop" a dough composition in a way that increases the stiffness, strength, and elasticity of the dough. Doughs commonly referred to as "developed" doughs are generally understood to include doughs that have a relatively highly-developed gluten matrix structure; a stiff, elastic rheology; and (due to the stiff, elastic matrix) are well able to form bubbles or cells that can stretch without breaking to hold a leavening gas while the dough expands, leavens, or rises, prior to or during cooking (e.g., baking). Features that are sometimes associated with a developed dough, in addition to a stiff, elastic rheology, include a liquid content, e.g., water content, that is relatively high compared to non-developed doughs; a sufficient (e.g., relatively high) protein content to allow for a highly-developed structure; optionally, processing steps that include time to allow the dough ingredients (e.g., gluten) to interact and "develop" to strengthen the dough; and on average a baked specific volume that is relatively higher than non-developed doughs. Oftentimes, developed doughs are yeast-leavened, but may be chemically leavened. Examples of specific types of doughs that can be considered to be developed doughs include doughs for pizza crust, breads (loaves, dinner rolls, baguettes, bread sticks), raised donuts, cinnamon rolls, croissants, Danishes, pretzels, etc.

As compared to "developed" doughs, doughs commonly referred to as non-developed doughs (or "un-developed" or "under-developed") have a relatively less developed ("undeveloped") dough matrix that gives the dough a relatively non-elastic rheology, reduced strength, and reduced gas-holding capacity. Being less elastic than a developed dough and exhibiting a reduced gas-holding capacity, non-developed doughs, on average, exhibit relatively lower raw and baked specific volumes. Examples of non-developed types of dough compositions include cake doughnuts, muffins, biscuits (e.g., soda biscuits), and the like.

A chemically-leavened dough composition according to the invention can include chemical leavening agents as described herein, along with other dough ingredients as known in the dough and baking arts, or as developed in the future to be useful with chemically-leavened dough compositions.

A flour component can be any suitable flour or combination of flours, including glutenous and nonglutenous flours, and combinations thereof. The flour or flours can be whole grain flour, flour with the bran or germ removed, or combinations thereof. Typically, a dough composition can include between about 30 and about 50 weight percent flour, e.g., from about 35 to about 45 weight percent flour, based on the total weight of a dough composition.

Examples of liquid components include water, milk, eggs, and oil, or any combination of these, as will be understood to be useful in chemically-leavened, non-developed dough compositions. For example, a liquid component may be water (added as an ingredient and as part of other ingredients), e.g., in an amount in the range from about 15 to 35 weight percent, e.g., from 25 to 35 weight percent, although amounts outside of this range may also be useful. Water may be added during processing in the form of ice, to control the dough temperature in-process; the amount of any such water used is included in the amount of liquid components. The amount of liquid components included in any particular dough composition can depend on a variety of factors including the desired moisture content of the dough composition.

A dough composition can optionally include fat ingredients such as oils and shortenings. Examples of suitable oils include soybean oil, corn oil, canola oil, sunflower oil, and other vegetable oils. Examples of suitable shortenings include animal fats and hydrogenated vegetable oils. Fat may be used in an amount less than about 20 percent by weight, often in a range from 5 or 10 weight percent to 20 weight percent fat, based on total weight of a dough composition. A dough composition can optionally include one or more sweeteners, either natural or artificial, liquid or dry. Examples of suitable dry sweeteners include lactose, sucrose, fructose, dextrose, maltose, corresponding sugar alcohols, and mixtures thereof.

Dough compositions which can be used with the invention can be prepared according to methods and steps that are known in the dough and dough product arts, including steps of mixing or blending ingredients, folding, lapping, forming, shaping, cutting, rolling, filling, etc.

The invention claimed is:

1. A wound package construct comprising:

a liner strip wound as a liner layer, the liner strip including two opposed liner edges, the opposed liner edges meeting at a spiral liner seam to form the liner layer having an interior side and an exterior side;

a bodystock strip wound as a bodystock layer on the exterior side of the liner layer, the bodystock strip including two opposed bodystock edges, the opposed bodystock edges meeting at a spiral bodystock seam to form the bodystock layer having an interior side and an exterior side;

a liner adhesive, provided between the exterior side of the liner layer and the interior side of the bodystock layer, bonding the liner layer and the bodystock layer;

a cover strip spirally wound on the exterior side of the bodystock layer and covering the spiral bodystock seam, the cover strip including adjacent cover strip edges that do not meet and do not overlap so as to remain spaced apart between the wound cover strip such that portions of the bodystock layer are exposed between the adjacent cover strip edges when the cover strip is fully wound on the bodystock layer; and a cover adhesive, provided between the exterior side of the bodystock layer and an interior side of the cover strip, bonding the cover strip and the bodystock layer to establish a container.

2. The package construct of claim 1, wherein the liner strip comprises a length having a uniform width between the two opposing liner edges, the uniform width being in a range from 2 to 6 inches.

3. The package construct of claim 2, wherein the bodystock strip comprises a length having a uniform width between the two opposed bodystock edges, the uniform width being in a range from 2 to 6 inches.

4. The package construct of claim 3, wherein the uniform width of the bodystock strip is approximately 4 inches.

5. The package construct of claim 3, wherein one of the two opposed bodystock edges abuts another of the two opposed bodystock edges without overlapping.

6. The package construct of claim 1, wherein one of the two opposing liner edges overlaps another of the two opposing liner edges at the spiral liner seam.

7. The package construct of claim 1, wherein the cover strip comprises a length having a uniform width in a range from 1 to 3 inches.

8. The package construct of claim 7, wherein the uniform width of the cover strip is approximately 1.5 inches.

9. The package construct of claim 7, further comprising: a label layer, exterior to each of the liner layer, the bodystock layer and the cover strip, the label layer being removable to expose both the cover strip and the portions of the bodystock layer.

10. The package construct of claim 9, wherein the label layer constitutes a sleeve positioned over the cover strip.

11. The package construct of claim 1, further comprising a raw dough provided in the container against the interior side of the liner layer, with the raw dough being under pressure, wherein the container is configured to be opened by applying pressure to the cover strip at the spiral bodystock seam, without removing the cover strip, to cause failure of the cover adhesive bonding the bodystock and the cover strip, and by applying further pressure to the spiral bodystock seam to open the container along the bodystock seam to allow removal of the raw dough.

12. The package construct of claim 1, further comprising a raw dough provided in the container against the interior side of the liner layer, with the raw dough being under pressure, wherein the container is configured to be opened by unwinding the cover strip to expose the bodystock seam, and then applying pressure to the spiral bodystock seam to open the container along the bodystock seam to allow removal of the raw dough.

13. A method of opening the container formed from the package construct of claim 1 comprising:

without removing the cover strip, applying pressure to the cover strip at the spiral bodystock seam to cause failure of the cover adhesive bonding the bodystock layer and the cover strip; and applying further pressure to the spiral bodystock seam to open the container along the bodystock seam.

14. A method of opening the container formed from the package construct of claim 1 comprising:

unwinding the cover strip to expose the bodystock seam; and applying pressure to the spiral bodystock seam to open the container along the bodystock seam.

15. A method of preparing a food package comprising:

spirally winding a liner strip to form a liner layer, the liner strip including opposed liner edges meeting at a liner seam to form the liner layer;

spirally winding a bodystock strip to form a bodystock layer on an exterior side of the liner layer, the bodystock strip including opposed bodystock edges meeting at a bodystock seam; and spirally winding a cover strip over the bodystock seam on an exterior side of the bodystock layer, with the cover strip having adjacent cover strip edges which do not overlap so as to remain spaced apart such that portions of the bodystock layer are exposed between the adjacent cover strip edges to establish a container.

16. The method of claim 15, further comprising:

placing liner adhesive between the liner layer and the bodystock layer; and placing cover adhesive between the cover strip and the bodystock layer.

17. The method of claim 15, further comprising, in spirally winding the liner strip, overlapping one of the opposing liner edges at the liner seam.

18. The method of claim 15, further comprising: placing a dough composition within the container.

19. The method of claim 15, wherein the bodystock strip which is spirally wound includes a length having a uniform width in a range from 2 to 6 inches between the opposed bodystock edges, and wherein the cover strip which is spirally wound includes a length having a uniform width in a range from 1 to 3 inches between the adjacent cover strip edges.

20. The method of claim 19, wherein the uniform width of the bodystock strip is approximately 4 inches and the width of the cover strip is approximately 1.5 inches.

* * * * *